United States Patent [19]

Horak

[11] 3,960,295

[45] June 1, 1976

[54] CONTINUOUS LIQUID PROPORTIONING SYSTEM

[76] Inventor: Vladimir Horak, 353 High St., Closter, N.J. 07624

[22] Filed: Aug. 19, 1974

[21] Appl. No.: 498,793

[52] U.S. Cl. ..... 222/145; 137/392; 222/21

[51] Int. Cl.[2] ..... B67D 5/60

[58] Field of Search ..... 222/14, 21, 22, 56, 222/57, 59, 76, 134, 145, 129; 137/392

[56] References Cited

UNITED STATES PATENTS

| | | | |
|---|---|---|---|
| 2,036,810 | 4/1936 | Hurrell | 222/134 |
| 2,942,613 | 6/1960 | Church | 137/396 |
| 3,437,108 | 4/1969 | Sorensen | 137/392 |

*Primary Examiner*—Stanley H. Tollberg
*Assistant Examiner*—H. Grant Skaggs
*Attorney, Agent, or Firm*—Edward F. Levy

[57] ABSTRACT

A liquid proportioning system includes two groups of positive metering tanks, each group consisting of at least two tanks each containing a supply of liquid to be blended and including outlet control device for selectively regulating the volume of liquid leaving the tank per unit of time. The liquids from each tank are fed together through a single conduit to a mixer which continuously blends the liquid components as they are flowing, and the blended liquids are fed to a reservoir tank, from which they are fed to a point of use in accordance with the variable requirements of the latter. One group of positive metering tanks feeds the liquid components to the mixer in exact proportions until these tanks are depleted, at which time the flow from these tanks is shut off automatically and the second group of tanks begins to feed the portioned liquid components to the mixer, while the first group of tanks are refilled. When the requirements of the point of use are decreased, sensors slow down the feeding of the liquid to the reservoir tank by increasing the time interval between the emptying of one group of metering tanks and the commencement of feeding from the other group of tanks.

10 Claims, 5 Drawing Figures

CONTINUOUS LIQUID PROPORTIONING SYSTEM

The present invention relates to continuous liquid proportioning systems and in particular to a proportioning system in which two or more liquids are fed together in exact proportions, then blended, and finally fed to a point of use, such as a filling department, in accordance with the varying requirements of the latter.

The most commonly used conventional system for proportioning and feeding liquids is the so-called "batching system" in which two or more liquids are inserted in a mixing tank in volumes of measured proportions, and are mixed within the tank to produce a homogenous mixture which is then fed to a filling station until the mixture is depleted. In filling the mixing tank, the individual liquids are measured by metering pumps or flow meters. When the mixture in the mixing tank becomes depleted, the supply to the filling station is cut off until the mixing tank is refilled with the individual liquids.

Batching systems of this type have the advantage of being capable of utilizing positive metering of the single components into the mixing tank. An additional advantage is that the filling station can determine the flow rate of the final mixture from the mixing tank; that is to say, the mixing tank is capable of varying its supply of mixture to the filling station in accordance with changing needs of the latter. Batching systems are, however, subject to several disadvantages; for example, the metering of the single components is usually of poor quality because of the operation of flow meters or metering pumps, or the introduction of human error in inserting a measured quantity of each liquid into the mixing tank. Such inherent inaccuracy in dosing makes it necessary to check the quality of the final product, which is normally done in a control laboratory and involves repeated mixing time and a costly operation. In addition, the entire system must be interrupted each time the mixing tank is emptied and must be refilled, resulting in loss of production time. The batching system equipment is also complex and expensive, and is also bulky, requiring considerable installation space.

There have, for many years, been attempts to replace batching systems with some kind of continuous blending method. Many different systems have been developed, ranging from simple flow rate regulations to very sophisticated and expensive electronically-controlled metering pumps and flow control devices. Each of these systems is itself subject to such inherent disadvantages that to the present there is no practical mixing, metering, and dispensing system which will provide continuous and efficient operation on an economic basis, with high and constant accuracy in proportioning.

It is an object of the present invention, therefore, to provide a liquid proportioning system which is continuous in operation, and in which two or more liquids are dispensed to a point of use employing only an absolute positive metering of volumes of all of the liquid components before they flow together.

Another object of the invention is the provision of a liquid proportioning system of the character described in which the mixing of the liquid components is continual and gradual, thereby eliminating the necessity for large mixing tanks as is required for the mixing of components in large batches.

Another object of the invention is the provision of a liquid proportioning system of the character described which does not require any control of flow rate of the liquids, such as by flowmeters, transmitters, controllers, automatic ratio setting devices, and like apparatus which are used in present day systems, so that the system of the present invention is extremely economical to install and maintain, and requires a minimum installation space.

Still another object of the invention is the provision of a liquid proportioning system of the character described which provides continuous and highly efficient liquid proportioning without utilizing any moving parts in the metering operation, thereby eliminating the need for metering pumps which are used in some systems.

A further object of the invention is to provide a liquid proportioning system of the character described which eliminates all of the disadvantages of both batching systems and systems employing metering pumps and flowmeters, thereby achieving extremely high accuracy in metering the liquid components, improved blending of the components during the time they are flowing, and elimination of the "idle time" during which the mixing tanks of the batching system are being refilled and tested.

In accordance with the present invention there is provided two groups of positive metering tanks, both groups connected to a mixer and arranged for alternate feeding of liquids to said mixer. Each of said groups comprises a plurality of positive metering tanks, each containing a supply of liquid component to be mixed with the liquid components of the other tanks in said group. The metering tanks in each group are connected by means which maintain a uniform pressure in each tank above the liquid component therein.

Each positive metering tank includes adjustable outlet means for feeding a selected volume of the contained liquid component from said tank per unit of time and in constant selected proportion to the liquid components fed from the other metering tanks in its group. The outlet means of each tank in a group are connected by a single conduit to the mixer, whereby the liquid components fed from the metering tanks flow continuously in exact metered proportions through said single conduit to said mixer. A reservoir tank is connected to the outlet of said mixer, and the outlet of said reservoir tank is connected to a point of use. Automatic control means are provided for closing the outlet means of the metering tanks in one group when said tanks become depleted, opening the outlet means of the tanks of the other group, and causing said one group of tanks to be refilled from said supply source while the other group of tanks is feeding liquid to said mixer.

The liquid proportioning system also includes sensing means for sensing changes in the level of liquid in said reservoir tank as a consequence of variations in the requirements of said point of use, said sensing means varying the flow of liquid from said mixing tank into said reservoir tank to compensate for said varying requirements by changing the time interval between the closing of the outlet means of the depleted group of metering tanks and the opening of the outlet means of the other group of metering tanks.

Additional objects and advantages of the invention will become apparent during the course of the following specification when taken in connection with the accompanying drawings, in which.

Figure 1:
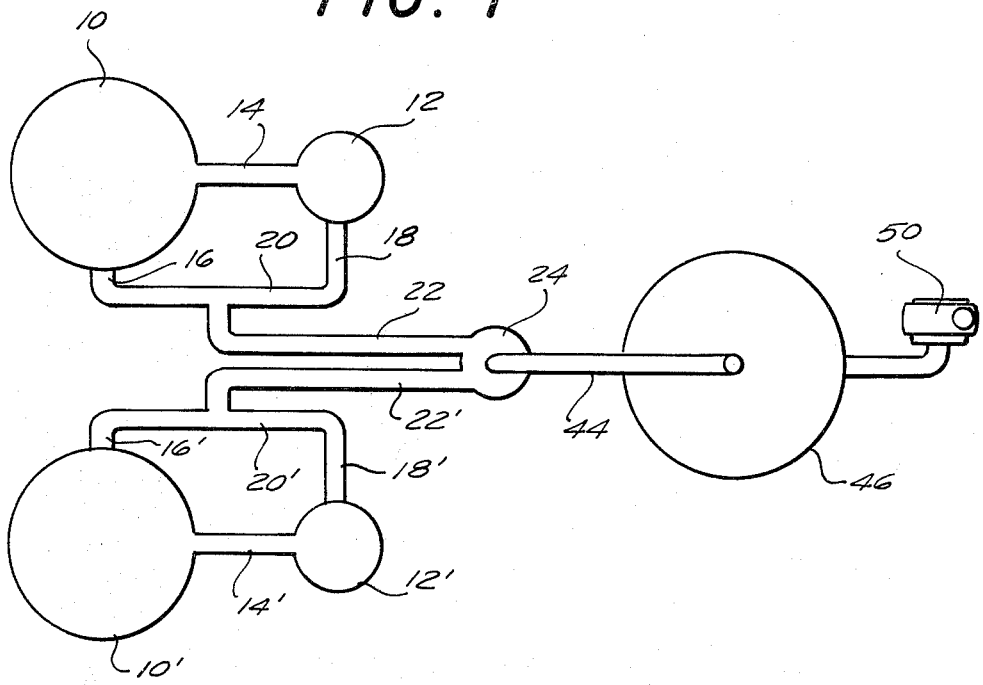
FIG. 1 is a schematic top plan view of a preferred embodiment of liquid proportioning system according to the present invention, showing two groups of positive metering tanks, each consisting of two tanks, connected to a mixer, which is in turn connected to a reservoir tank.

Referring in detail to the drawings, there is shown in FIG. 1 a top view of a liquid proportioning system according to the present invention. The system includes a first pair of positive metering tanks 10 and 12, and a second pair of identical positive metering tanks 10' and 12' which operate alternately with the first pair.

The first pair of metering tanks 10 and 12 are connected at their upper ends by a conduit 14 for equalization of internal pressure within said tanks, as will be presently described, and the metering tanks 10' and 12' are similarly connected by a conduit 14'. The liquids within tanks 10 and 12 are fed through respective outlet pipes 16 and 18 and are combined within a conduit 20, from which the combined liquids flow through pipe 22 to a blender 24. Similarly, the tanks 10' and 12' have respective outlet pipes 16' and 18' leading to conduit 20' which is connected by pipe 22' to the interior of blender 24.

Figure 2:
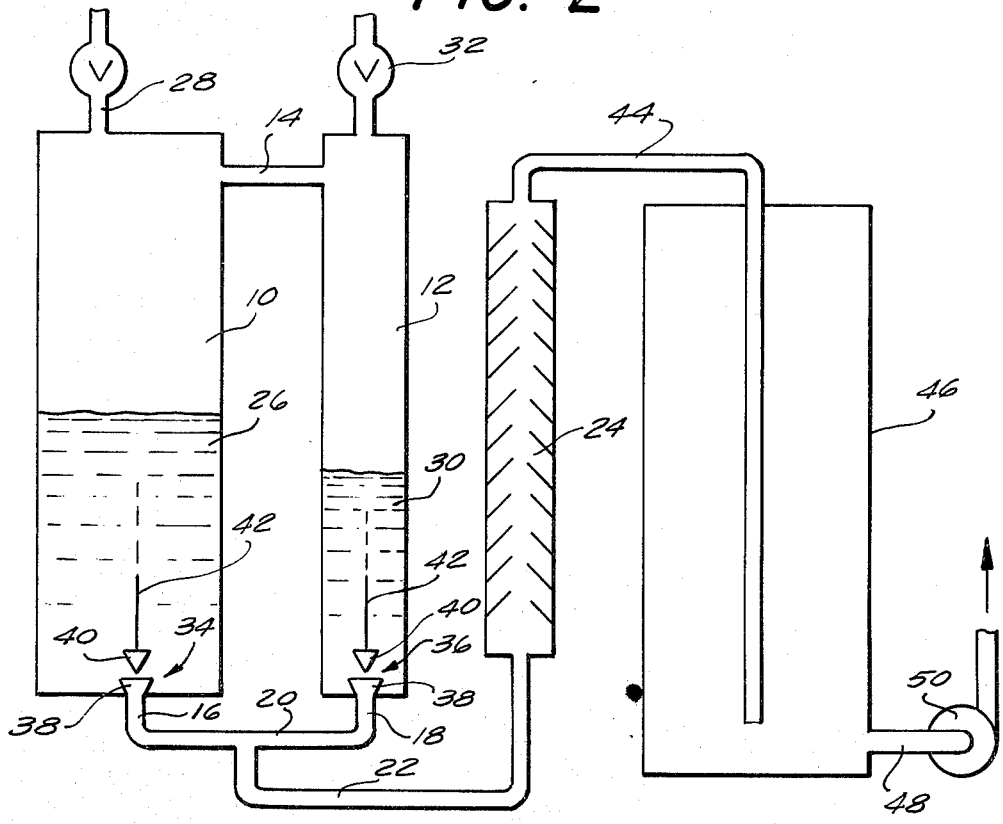
FIG. 2 is a schematic side elevational view of the liquid proportioning system shown in FIG. 1, showing the interiors of one group of metering tanks, the mixer, and the reservoir tank.

FIG. 2 is an elevational view of the first pair of positive metering tanks 10 and 12, showing the interior structures therein and the relationship of such tanks 10 and 12 to the remaining components of the system. Since the second pair of metering tanks 10' and 12' are identical in construction to the first pair 10 and 12, the description of the latter, to follow, will apply equally to the second pair of tanks 10' and 12'.

The tank 10 is adapted to be filled to a selected, measured quantity of liquid 26 through an automatic supply valve 28 connected to a source of said liquid 26. The tank 12 is also adapted to be filled to a selected measured quantity of liquid 30 through an automatic supply valve 32 connected to a source of said liquid 30.

At the bottom of metering tank 10 is an outlet valve 34 which communicates with outlet pipe 16, and at the bottom of metering tank 12 is an outlet valve 36 which communicates with outlet pipe 18. These outlet valves 34 and 36 may be any suitable type of metering valve which will dispense a metered amount of liquid per unit of time, and are preferably automatic plug valves of the type described in U.S. Pat. No. 3,780,981. In this preferred form, the valves 34 and 36 each include a valve seat 38 having a tapered, frusto-conical surface, and a cooperating valve head 40 of conical shape. Each valve head 40 is carried by a long valve stem 42 which extends through the interior of the respective tank 10 or 12 and is controlled by electromagnetic solenoid means (not shown) at the top of the tank for lifting the valve head 40 from the seat 38 when the solenoid means is energized. In addition, means (not shown) are provided for precisely adjusting the position to which the valve head 40 may be raised from the valve seat when it is lifted by the valve stem 42, so that the flow rate of liquid through the valve may be precisely and selectively set and controlled. Such adjustment means is described in detail in the aforementioned U.S. Pat. No. 3,780,981, and reference is made thereto for further disclosure.

The blender 24 communicates at its upper end with an outlet pipe 44 which extends into a reservoir tank 46 and feeds into the bottom thereof. Also at the bottom of reservoir tank 46 is an outlet pipe 48 communicating with a transfer pump 50 which feeds the liquid from reservoir tank 46 to the "point of use" which may be bottling equipment or other filler equipment (not shown) whose requirements of liquid volume may vary from time to time. The pump 50 may be selectively driven with variable revolutions which changes the output capacity of the pump within upper and lower limits depending upon the requirements of the bottling or filling equipment being supplied.

In the broad aspects of the liquid proportioning system of the present invention, the metering tanks 10, 12 and 10', 12' are adapted to feed the two different liquids 26 and 30 contained therein in an exact proportioned ratio through the blender 24 to the reservoir tank 46 in accordance with the capacity and demands of the latter. Further, the pair of tanks 10 and 12 operate alternately with the tanks 10' and 12' to feed proportioned liquids to the reservoir tank. Thus, the tanks 10 and 12 feed their contained liquids until they become empty, at which time the tanks 10' and 12' begin feeding while the tanks 10 and 12 are refilled. The reservoir tank 46 is adapted to feed the blended liquid to the point of use and to control the flow rate of the blended liquid, as well as the fill rate of the metering tanks, according to the requirements of the filling equipment at the point of use.

Figure 3:
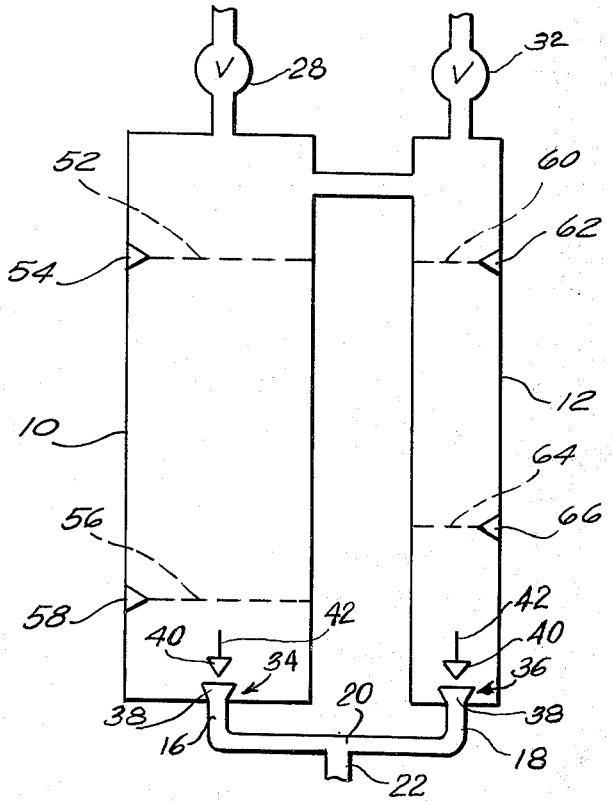
FIG. 3 is a schematic elevational view of the metering tanks shown in FIG. 2, illustrating further interior structure thereof.

FIG. 3 shows the positive metering tanks 10 and 12 in detail. It will be seen that the tank 10 has a zero level 52 which constitutes the level at which the tank is filled to capacity. Located at this zero level 52 is an electric sensor 54. The tank 10 has a selected refill level 56 constituting that level at which the liquid in the tank is essentially depleted so that the tank must be refilled. Located at this level 56 is an electric sensor 58. Similarly, the positive metering tank 12 has a zero level 60 at which is located an electric sensor 62 and a refill level 64 at which is located a sensor 66.

The electric sensors 54 and 58, and the sensors to be described hereinafter, may be any conventional sensor capable of being energized when the liquid reaches the level at which the sensor is mounted. The sensors may, for example, be of the type in which a magnetic float is supported by the liquid within a tank or container and actuates one or more magnetic reed switches located outside the tank when the liquid reaches the level to be sensed and regulated. Such type of sensor is shown and described in U.S. Pat. No. 3,703,246.

Figure 5:
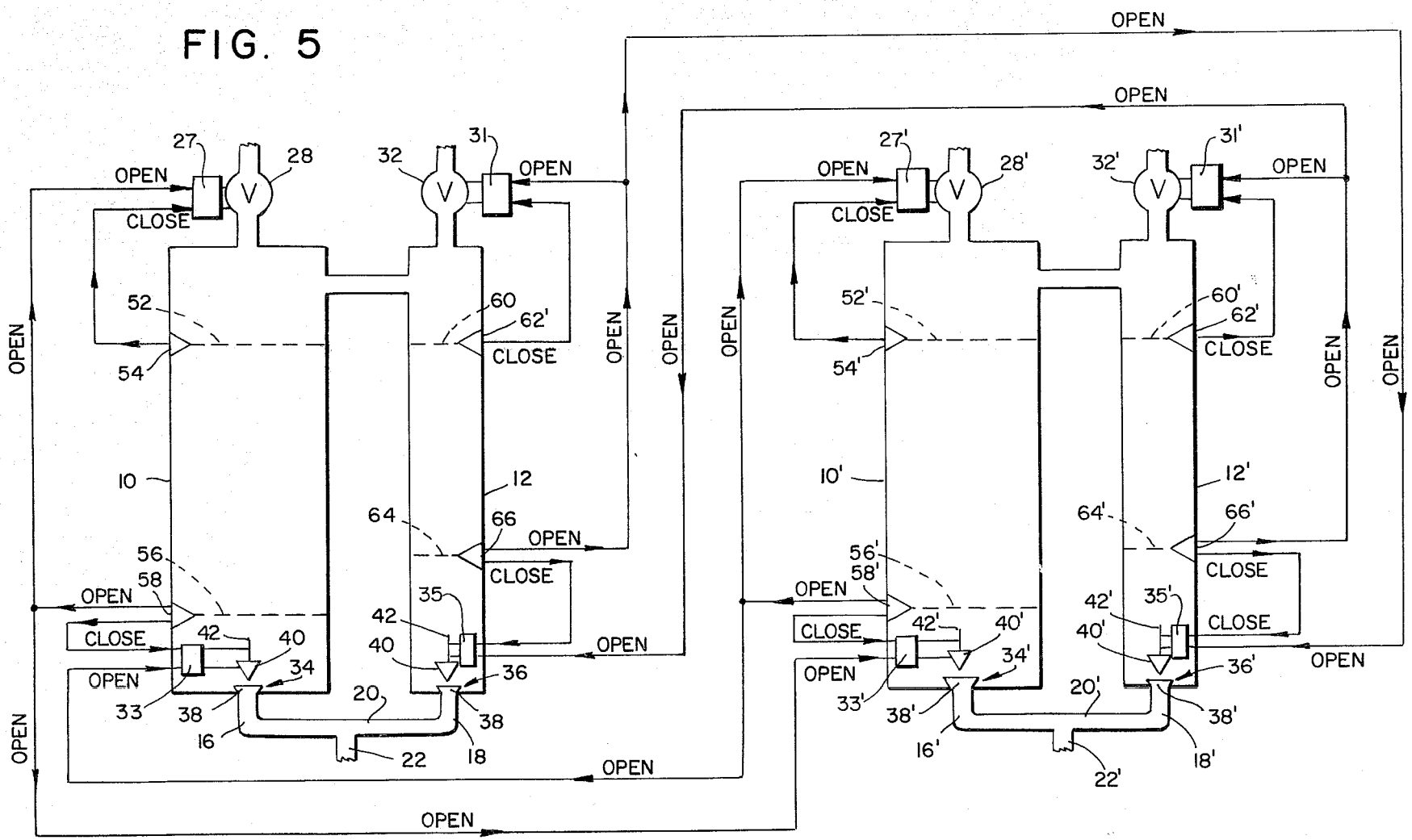
FIG. 5 is a schematic diagram functionally showing the flow of the electrical signals from the electrical liquid level sensors to the appropriate inlet and outlet valves of the positive metering tanks of FIG. 1.

The positive metering tanks 10 and 12 may be of different sizes, as shown, and are adapted to dispense their liquids in a selected proportion. For example, the rate of flow from the tanks 10 and 12 may be so regulated that the combined liquid fed to the blender 24 consists of 65% of the liquid 26 from tank 10 and 35% of the liquid 30 from tank 12. Such proportion may be obtained with high precision by adjusting the distances by which the valve heads 40 may be lifted from the valve seats 38. Thus, when the tanks 10 and 12 are filled to their respective zero levels 52 and 60, the outlet valves 34 and 36 are opened simultaneously and the dispensing of both liquids 26 and 30 starts simultaneously, in the proportion of 65% of liquid 26 and 35% of liquid 30. The refill lines are so located that the liquid 26 in tank 10 will reach its refill line 56 at the same time that the liquid 30 in tank 12 reaches its refill line 64, so that the dispensing action of both tanks 10 and 12 end simultaneously. This timing assures that both liquids 26 and 30 are moving through the feed lines 16, 18, 20 and 22 at the given proportion at every point of cross section, and also assures that the correct proportion enters the blender 24. As functionally illustrated in FIG. 5, when the liquids 26 and 30 in tanks 10 and 12 reach their respective refill lines 56 and 64, the corresponding sensors 58 and 66 are simultaneously energized and respectively transmit close electrical signals to control means 33 and 35 respectively which may respectively comprise a solenoid to close outlet valves 34 and 36 to close the same and simultaneously means 33' and 35' respectively to thereby open outlet valves 34' and 36' of the other pair of metering tanks 10' and 12'. Thus the first metering cycle of tanks 10 and 12 is completed and a second metering cycle of tanks 10' and 12' is immediately commenced. At the same time, sensors 58 and 66 respectively transmit electrical OPEN signals to control means 27 and 31 whereby the inlet valves 28 and 32 are opened, causing tanks 10 and 12 to be refilled while tanks 10' and 12' are emptying. When the liquids in tanks 10 and 12 again reach the respective zero levels 52 and 60, the sensors 54 and 62 are actuated respectively transmitting CLOSE signals to control means 27 and 31 to close inlet valves 28 and 32. When the second metering cycle provided by tanks 10' and 12' is completed and the liquids in these tanks reach refill levels, the sensors 58' and 66' are actuated thereby transmitting CLOSE signals to control means 33' and 35' to close outlet valves 34' and 36 and simultaneously transmit OPEN signals to control means 33 and 35 to open outlet valves 34 and 36 of tanks 10 and 12 recommence the first cycle. The cycles are repeated continuously and alternately, one pair of tanks refilling while the other pair is dispensing. It is obvious that if three or more liquids are to be mixed and blended, a corresponding number of tanks will be employed in each cycle.

The conduit 14 is located above the zero level of the liquids and serves to equalize the pressure in both tanks above the liquid levels. Any desired pressure within the tanks may be employed, ranging from hydrostatic pressure to above-atmospheric pressure of air or gas, depending upon the characteristics of the liquids to be dispensed. In any event, if any pressure is employed, it must be equal in both tanks 10 and 12 or 10' and 12'.

The blender 24 illustrated in FIG. 1 is a so-called "motionless blender" having a series of internal vanes or baffles which provides a vortex action to the combined liquids flowing through the blender so that as the liquids are fed therefrom through outlet pipe 44, they have been completely blended. If required by the nature or viscosity of the liquids dispensed, the blender may be an in-line mixer or any other type of mixer capable of blending the given liquids. The blending equipment may be adjusted to the required mixing conditions; for example, it may be cooled or heated if temperature changes are caused or required by the mixing action, or special pressure conditions can be maintained. Thus, all conditions normally employed in mixing tanks can be included in the system.

Figure 4:
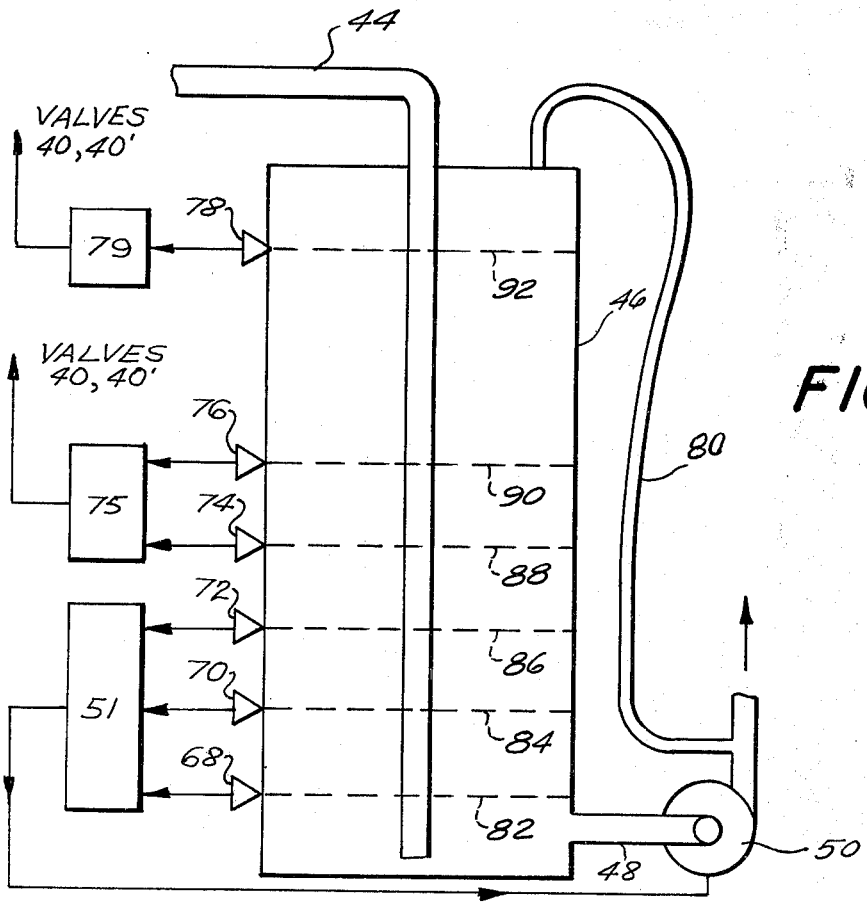
FIG. 4 is a schematic elevational view of the reservoir tank shown in FIG. 2, illustrating further interior structure thereof.

The reservoir tanks 46 is shown in detail in FIG. 4, and is basically an intermediate storage tank of small size which automatically controls its own intake and output of liquid not only between minimum and maximum levels therein, but also in accordance with the changing capacity and requirements of the "point of use" which it feeds.

The so-called point of use is a filling department in which a number of bottling machines may be using, for example, 100 gallons of liquid per minute, if all are working at normal capacity. As frequently happens, one of the machines may develop a defect, requiring that operation of the machine be temporarily halted. This decreases the capacity of the filling department to 80 gallons per minute, and the reservoir tank is required to deliver the blended liquid at this reduced rate while maintaining constant accuracy in the proportioning of the liquids, and when the bottling department requirements are again at full capacity, the reservoir tank must resume full delivery of the blended liquid with the same accuracy in proportion.

Within the tank 46 is a vertical row of sensors 68, 70, 72, 74, 76 and 78 located at selected designated liquid levels in the tank. The six sensors are shown merely as an illustrative example, the number of sensors and the distances therebetween being variable according to the blending and dispensing operation of the system. A bypass line 80 is interposed between the outlet pipe of pumps 50 and the top of tank 46.

The liquid level 82 at sensor 68 constitutes the level at which the liquid is normally maintained when all machines in the filling department are operating at full efficiency and the liquid requirements of the point of use is therefore 100%. The liquid levels 84, 86, 88 and 90 represent those levels in the tank 46 when the requirements of the filling department decrease below normal 100%. If because of the incapacity of one or more bottling machines, the requirements of the filling department drops from 100% to 60%, for example, the pump 50 will continue to operate at its original output speed, but some of the liquid pumped therethrough will be returned to the reservoir tank through the bypass line 80. The liquid level in the tank will therefore begin to rise above the normal level 82 until it reaches the next designated level 84. This causes the sensor 70 to be energized, said sensor sending an electrical impulse to a speed control unit 51 for pump 50 so as to slow down the rate of rotation and consequent delivery rate of said pump. Due to the decrease in outlet flow from tank 46, the liquid level will continue to rise, and as it reaches the levels 84 and 86, the respective sensors 70 and 72 will further decrease the rotational speed of the pump 50. When the liquid reaches the level 88, the sensor 74 is energized, producing a signal which is applied to interval control unit 75 which will increase the intervals between the alternating first and second cycles. Thus, when tanks 10 and 11 complete the first cycle of metered dispensing, there will be a selected time interval before the other pair of tanks 10' and 11' commence the second metering cycle, and then another selected time interval between the end of the second cycle and the beginning of the next first cycle.

The time delay imposed between alternate cycles has the effect of decreasing the rate of feed to the reservoir tank 46 over an extended period. If this decrease is sufficient to maintain the liquid at level 88, the system will continue to function at this decreased feed and output rate so long as the point of use maintains its decreased requirement. If, however, the liquid in tank 46 continues to rise to the level 90, the sensor 76 will be actuated, further increasing the time interval between the alternating first and second cycles. Additional sensors may be located at successive levels above the level 90 to further increase the interval between the alternating cycles. In normal circumstances, the liquid in tank 46 should reach a level at which the input from the metering tanks matches the output drawn by the pump 50 operating at reduced capacity, and the operation of the system will stabilize at this level until the machines in the filling department are all placed in operation and the point of use is again at 100% capacity requirement. In this instance, the liquid in the tank 46 will decrease through the various levels and the control operation described above will be reversed.

If the liquid reaches the maximum level 92 of tank 78, it signifies that the demand of the point of use has dropped to such an extent that it cannot keep up with the minimum supply rate of the metering tanks 10, 12 and 10′, 12′. This may be caused, for example, by a complete power failure in the filling department. Presence of the liquid at level 92 actuates sensor 78 which applies an output signal to control means 79, such as a solenoid stops the metering action entirely by closing all outlet valves of the metering tanks 10, 12 and 10′, 12′.

In the event that the particular installation requires a larger range between lowest and highest capacity levels of the reservoir tank than one pump is able to cover, then a second pump of lower capacity may be employed. This second pump is installed to take over the fluid delivery automatically if the larger pump is unable to operate at a sufficiently slow speed as required by the point of use.

It will be appreciated that an advantageous feature of the invention lies in the continuous feeding of the liquid components from the metering tanks 10, 12 or 10′, 12′ in exact measured proportions with the flow rate maintained constant throughout the entire operation. Thus when the liquid components meet and flow together through the single common conduit 22 or 22′, the single stream of combined liquid components continuously maintains the required proportion of these components throughout every point in the cross-section of the single conduit, until the liquid reaches the blender 24, in which the liquids are mixed in these metered proportions.

While a preferred embodiment of the invention has been shown and described herein, it is obvious that numerous omissions, changes and additions may be made in such embodiment without departing from the spirit and scope of the invention.

What is claimed is:

1. A liquid proportioning system comprising:

first and second groups of positive metering tanks, both connected to a mixer and arranged for alternate feeding to said mixer, each of said groups including a plurality of positive metering tanks, each containing a supply of liquid component to be mixed, and each being connected to a supply source of liquid component for filling said tank, means connecting the tanks in each of said groups for maintaining a uniform pressure in said tanks above the liquid component therein, each positive metering tank including adjustable outlet means for feeding a selected volume of the contained liquid component from the tank per unit of time and in constant selected proportion to the liquid components fed from the other metering tanks in its group, a single conduit connecting the outlet means of each metering tank in one group to said mixing tank, whereby the liquid components fed from said metering tanks flow continuously in exact measured proportions through said conduit to said mixer, a reservoir tank connected to the outlet of said mixer, means connecting the outlet of said reservoir tank to a point of use, and control means for closing the outlet means of the metering tanks of one group when said one group of tanks becomes depleted, opening the outlet means of the other group of metering tanks, and causing said one group of tanks to be refilled from said supply source while said other group of tanks is feeding liquid to said mixer.

2. A liquid proportioning system according to claim 1 in which said mixer is an in-line blender to which the liquid components of said metering tanks are fed in metered proportions in a continuous stream through said single conduit, and in which the liquid components are blended to a homogenous mixture as they pass through said mixer.

3. A liquid proportioning system according to claim 1 in which said outlet means of said positive metering tanks are outlet valves having tapered valve heads cooperating with tapered valve seats and moveable between a closed position in which the valve heads are seated in said valve seats and an open position in which said valve heads are elevated a selected distance above said valve seats to provide a constant measured flow of liquid therethrough.

4. A liquid proportioning system according to claim 1 in which first sensor means are located in each metering tank at a position corresponding to the filled liquid level of said tank, and second sensor means are located in said tank at a position corresponding to the depleted liquid level in said tank, said second sensor means being operative to close the outlet means of said tank, when the liquid reaches the depleted level, actuate the supply source for filling said tank, and open the outlet means of the corresponding tank in the other group, said first sensor means being operative to de-actuate the supply source when said tank has been refilled to said filled liquid level.

5. A liquid proportioning system according to claim 1 in which liquid is fed from said reservoir tank in accordance with the requirements of said point of use and the level of liquid in said reservoir tank varies in accordance with changes in the requirements of said point of use, and in which said system also includes a plurality of sensor means arranged at various levels in said reservoir tank and adapted to sense a rise of the liquid in said reservoir tank above a normal level, as a result of a decreased liquid requirement of said point of use.

6. A liquid proportioning system according to claim 5 in which said sensor means is adapted to return to said reservoir tank liquid fed out of the outlet thereof when the liquid in said reservoir tank rises to a first selected level above said normal level.

7. A liquid proportioning system according to claim 6 in which pump means are connected to the outlet of said reservoir tank for supplying liquid to said point of use, and a bypass line connects the outlet of said pump means to the interior of said reservoir tank, said bypass line being actuated to return liquid to said reservoir tank when the contained liquid therein reaches said first selected level.

8. A liquid proportioning system according to claim 6 in which said sensor means includes means adapted to increase the duration of the time period between the closing of the outlet means of one depleted group of metering tanks and the opening of the valve means of the other group of metering tanks when the contained liquid in the reservoir tank reaches a second selected level above said first selected level.

9. A liquid proportioning system according to claim 8 in which said sensor means includes means for further progressively increasing the duration of the time period between the closing of the outlet means of one depleted group of metering tanks and the opening of the valve means of the other group of metering tanks when the contained liquid in the reservoir tank reaches successive selected levels above said second selected level.

10. A liquid proportioning system according to claim 9 in which said sensor means includes means for closing the outlet means of both groups of metering tanks when the contained liquid in the reservoir tank reaches a level corresponding to the maximum filled level of said reservoir tank.

* * * * *